US007621168B2

(12) United States Patent
Lin

(10) Patent No.: US 7,621,168 B2
(45) Date of Patent: Nov. 24, 2009

(54) METHOD FOR PRODUCING HEXAGONAL WASHER

(75) Inventor: Chen-Mao Lin, Tainan Hsien (TW)

(73) Assignee: Tech Stell Co., Ltd., Tainan Hsien (TW)

( * ) Notice: Subject to any disclaimer, the term of this patent is extended or adjusted under 35 U.S.C. 154(b) by 721 days.

(21) Appl. No.: 11/428,579

(22) Filed: Jul. 5, 2006

(65) Prior Publication Data

US 2008/0034566 A1 Feb. 14, 2008

(51) Int. Cl.
*B21J 11/00* (2006.01)

(52) U.S. Cl. ..... 72/404; 72/405.02; 470/41; 470/162

(58) Field of Classification Search ..... 72/334, 72/335, 337, 404, 405.01, 405.02; 470/25, 470/26, 41, 42, 89, 95, 162, 163
See application file for complete search history.

(56) References Cited

U.S. PATENT DOCUMENTS 2,352,118 A * 6/1944 Poupitch ..... 470/41
2,649,125 A * 8/1953 Poupitch ..... 411/165
2,716,247 A * 8/1955 Poupitch ..... 411/165
3,981,060 A * 9/1976 Alling et al. ..... 29/898.041
4,024,593 A * 5/1977 Pendell ..... 470/18
7,331,874 B2 * 2/2008 Lin ..... 470/41

* cited by examiner

*Primary Examiner*—Edward Tolan
(74) *Attorney, Agent, or Firm*—Leong C. Lei

(57) ABSTRACT

Hexagonal washers are formed by the following steps: at least two through holes are provided in the middle of a belt of material, which are also used for positioning and advancing the belt; a first residual slot is formed between every two adjacent through holes; a second residual slot and a third residual slot are formed at the two sides of every first residual slot, thereby forming a hexagonal ring around each through hole; six wedge planes are forged around the bottom surface of each ring, and at least a V-shaped groove or a ridge is forged on the top surface of each ring; a larger through hole as the inner hole of a washer is produced at the center of each ring; the major shape of each washers is then formed without separating the washers from the belt; and the washers are fine-tuned to obtain the precise form factor and dimension before they separated from the belt.

4 Claims, 4 Drawing Sheets

METHOD FOR PRODUCING HEXAGONAL WASHER

BACKGROUND OF THE INVENTION (a) Technical Field of the Invention

The present invention generally relates to washers, and more particularly to a method for producing hexagonal washers having wedge planes, V-shaped grooves, and ridges on the top and bottom surfaces of the washers.

(b) Description of the Prior Art

FIG. 1 is a top view showing the steps of a conventional method in producing washers. As illustrated, in step A, at least two sets of two guiding holes 11 are formed at corresponding locations along the two edges of a belt of material 10. The guiding holes 11 are for guiding the subsequent process. A through hole 12 is then formed in step B by stamping between every two adjacent sets of guiding holes 11 in the middle of the bell 10. A first residual slot 13 and a second residual slot 14 are also formed correspondingly by stamping at the two sides of every through hole 12 along the two edges of the belt 10 respectively. Then, in steps C and D, third residual slots 15 are formed between every two adjacent through holes 12 so that a circular ring 16 is formed around every through hole 12 which is still attached to the belt 10 by four legs 17. In step E, a number of sloped surfaces are formed radially around each ring 16 by cold forging. The sloped surfaces are further forged in step F so that desired precision and dimension are achieved. After a do-nothing step G, a through hole 18 of larger aperture is formed around each through hole 12 in step H. Then, after another do-nothing step I, the material around each ring 16 is stamped off in step J. Then, the belt 10 is cut down to separate the washer in step K.

The foregoing method indeed can produce washers having variable thickness. However, the method has a number of shortcomings. First, the foregoing process is too complicated. Additionally, as people of the related arts should know, the two do-nothing steps add unnecessary cost to the process. Secondly, as the sloped surfaces are forged before fine-tuning for the desired precision and dimension, the rings cannot be positioned accurately so that the rings might be damaged during the fine-tuning process, causing a less satisfactory yield. Thirdly, each ring is supported by four legs which are connected to where the ring has the smallest thickness. Residuals at these locations therefore cannot be dispersed easily and the accumulated residuals might deform the ring.

FIG. 2 are perspective views showing the top and bottom surfaces of a hexagonal washer 6 having sloped surfaces 61, ridges 62, and V-shaped grooves 63. The hexagonal washer 6 provides superior performance than the conventional circular washer. However, the foregoing method is not appropriate for producing hexagonal washers 6.

SUMMARY OF THE INVENTION

The primary purpose of the present invention is to provide a method to manufacture hexagonal washers whose top and bottom surfaces have wedge planes, V-shaped grooves, and ridges.

The method provided contains the following steps: at least two through holes are provided in the middle of a belt of material which are also used for positioning and advancing the belt; a first residual slot is formed between every two adjacent through holes; a second residual slot and a third residual slot are formed at the two sides of every first residual slot, thereby forming a hexagonal ring around each through hole; six wedge planes are forged around the bottom surface of each ring, and at least a V-shaped groove or a ridge is forged on the top surface of each ring; a larger through hole as the inner hole of a washer is produced at the center of each ring; the major shape of each washer is then formed without separating the washer from the belt; and the washer is fine-tuned to obtain the precise form factor and dimension before it is separated from the belt.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
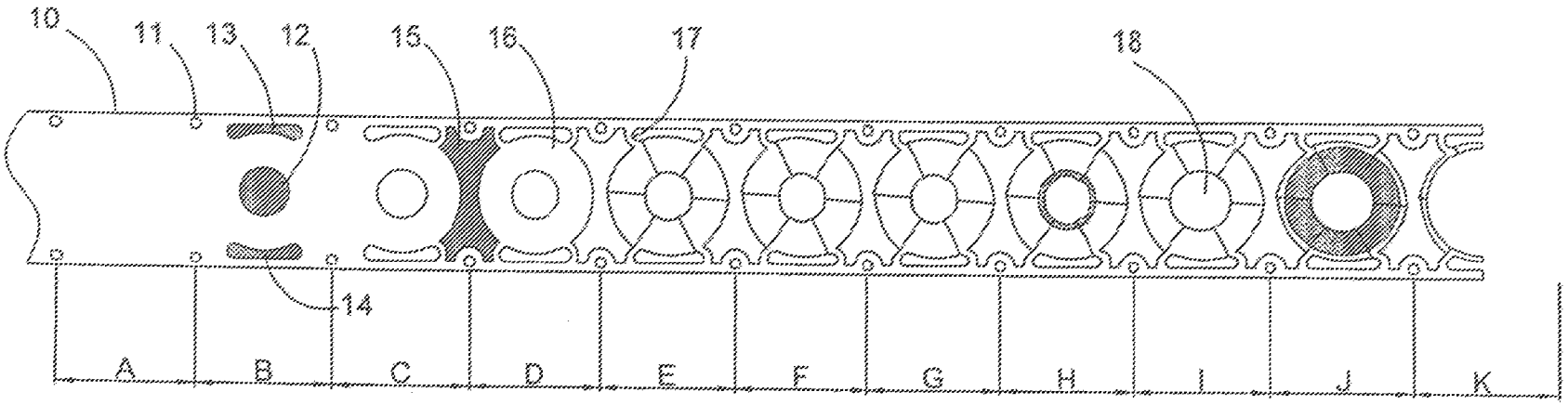
FIG. 1 PRIOR ART
FIG. 1 is a top view showing the steps of a conventional method in producing washers.
Figure 2:
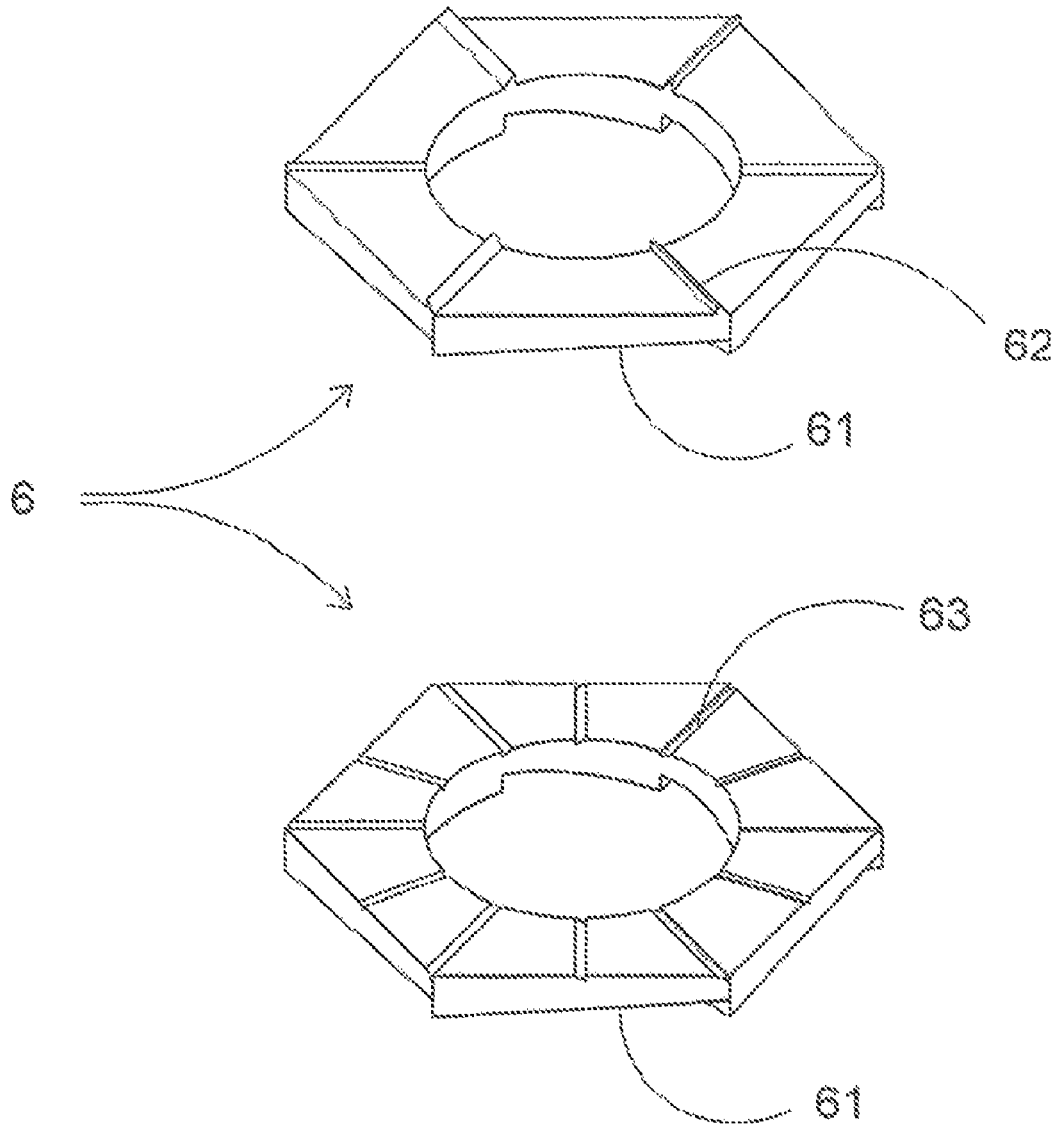
FIG. 2 PRIOR ART
FIG. 2 are perspective views showing the top and bottom surfaces of a hexagonal washer having sloped surfaces, ridges, and V-shaped grooves.
Figures 3A, 3B:
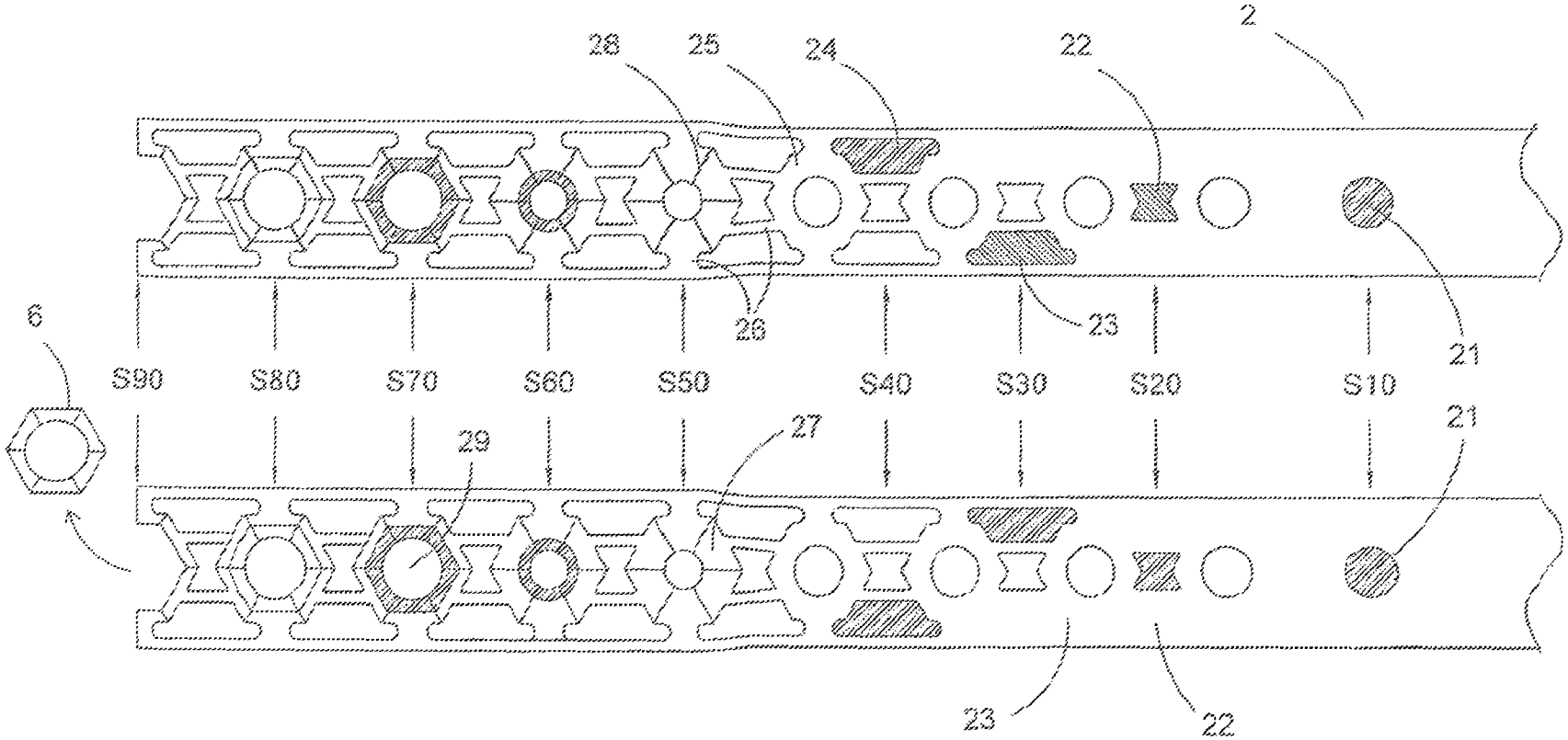
FIG. 3A is a top view showing the belt of material after each step of the present invention.
FIG. 3B is a bottom view showing the belt of material after each step of the present invention.
Figure 4:
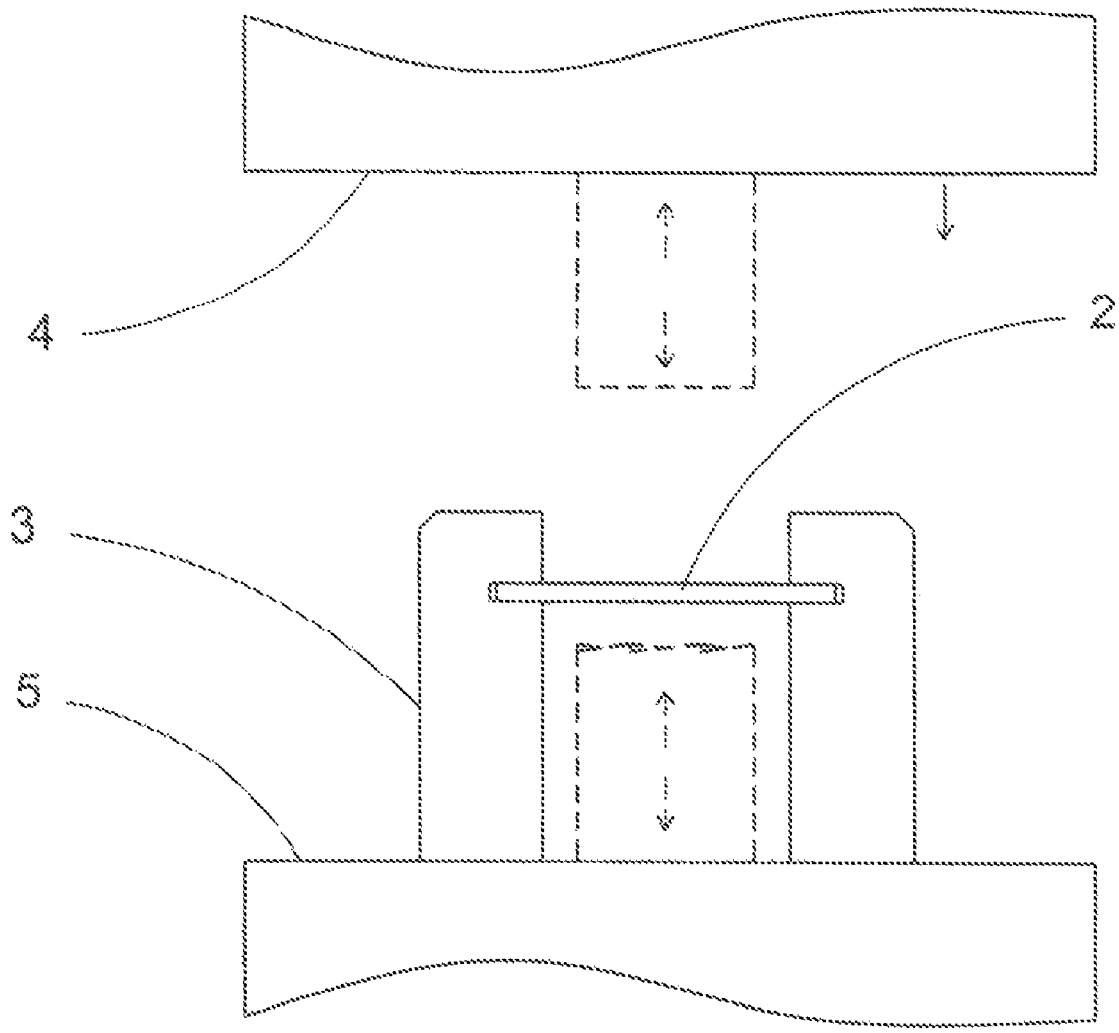
FIG. 4 is a schematic view showing the positional relationship between the belt of material and the molds along the direction of the belt.

As illustrated in FIG. 4, the present invention provides a method to produce hexagonal washers. The method prepares the material as a belt 2 and supports the belt 2 by a number of stands 3 between an upper mold 4 and a lower mold 5. Then, by stamping and cold forging, the method forms structures such as wedge planes (i.e., sloped surfaces), V-shaped grooves, and ridges on the top and bottom surfaces of the belt 2. In the following, the method is described assuming that six wedge planes are formed on the bottom surface and ridges are formed on the top surface of the belt 2, respectively, as illustrated in FIGS. 3B and 3A.

In step S10, a number of tough holes 21 are provided in the middle of the belt 2 by stamping. These through holes 21 are also used for positioning and guiding the subsequent process.

In step S20, a first residual slot 22 is formed by stamping between every two adjacent through holes 21. The first residual slot 22 has a shape similar to a sandglass.

Then, in steps S30 and S40, a second residual slot 23 and a third residual slot 24 are formed by stamping in the two regions between every first residual slot 22 and the two edges of the belt 2 respectively. The second and third residual slots 23 and 24 are shaped so that a hexagonal ring 25 is formed around every through hole 21. A ring 25 is still connected to the two edges of the belt 2 and the adjacent rings 25 by a number a legs 26.

In step S50, the lower mold 5 is used to forge six wedge planes 27 running continuously around the bottom surface of a ring 25. In the mean time, the upper mold 4 is used to forge six ridges 28 radiating from the through hole 21 to the surrounding first, second, and third residual slots 22, 23, and 24, respectively. The residuals produced by the forging are diffused to the through hole 21 and the first, second, and third residual slots 22, 23, and 24. Please note that the legs 26 are connected to the centers of the outer edges of the six wedge planes 27 respectively.

In step S60, a through hole 29 concentric to the through hole 21 but having a lager aperture is formed by stamping. The through hole 29 is the inner hole of a washer to be produced by the present invention.

Then, in step S70, the major shape of a washer is formed by stamping from the bottom around a through hole 29. Please note that the washer is still connected to the belt 2.

In stop S80, the upper and lower molds 4 and 5 are used to fine tune the washer so as to obtain the precise form factor, dimension, and levelness. Finally, in step S90, the formed washer is separated from the belt 2 by stamping.

The present invention has a number of advantages. First, the method is simple and, especially with the through holes 21 used for guiding, the investment on the molds can be significantly reduced. Secondly, in the foregoing embodiment, the wedge planes 27 are formed at the bottom surface and the method is thereby able to provide significantly improved yield as the washers are precisely positioned by the mold and the wedge planes 27. Thirdly, the legs 26 are connected to the centers of the sides of the washer which are places less prone to the deformation of the washer. This again helps improving the yield of the present invention. Additionally, after the first, second, and third residual slots 22, 23, and 24 are stamped, the hexagonal shape of the washer is basically formed, facilitating the subsequent forging and the dispersion of the residuals.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A method for producing hexagonal washers by having upper molds and lower molds working on the top and bottom surfaces of a belt of material supported therebetween, said method comprising the steps of:

forming at least two through holes in the middle of said belt which are used for positioning and guiding the subsequent process;

forming a first residual slot between every two adjacent said through holes;

forming a second residual slot and a third residual slot at corresponding locations along the two sides of every said first residual slot, thereby forming a hexagonal ring around each said through hole;

forming a plurality of wedge planes around the bottom surface of each said ring by a said lower mold, and forging at least a V-shaped groove or a ridge radiating from said through hole on the top surface of each said ring by a said upper mold;

forming a larger through hole as the inner hole of a washer at the center of each said ring;

forming the major shape of each washer without separating said washers from said belt;

fine-tuning said washers to obtain the precise form factor and dimension; and separating said washers from said belt.

2. The method according to claim 1, wherein each of said first residual slots has a shape substantially similar to a sandglass.

3. The method according to claim 1, wherein each of said rings is connected to the two edges of said belt and adjacent said rings by a plurality of legs.

4. The method according to claim 3, wherein each of said legs is connected to the center of the outer edge of a said wedge plane.

* * * * *